US006780829B1

(12) United States Patent
Kischkel et al.

(10) Patent No.: US 6,780,829 B1
(45) Date of Patent: Aug. 24, 2004

(54) TENSIDE GRANULATES COMPRISING FATTY ALCOHOL SULFATE AND OLEFIN SULFONATES

(75) Inventors: Ditmar Kischkel, Monheim (DE); Manfred Weuthen, Langenfeld (DE); Jutta Stute, Cologne (DE); Stefan Podubrin, Duesseldorf (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 0 days.

(21) Appl. No.: 09/868,549

(22) PCT Filed: Dec. 10, 1999

(86) PCT No.: PCT/EP99/09739

§ 371 (c)(1),
(2), (4) Date: Aug. 7, 2001

(87) PCT Pub. No.: WO00/37593

PCT Pub. Date: Jun. 29, 2000

(30) Foreign Application Priority Data

Dec. 19, 1998 (DE) ..... 198 58 886

(51) Int. Cl.[7] ..... C11D 17/00

(52) U.S. Cl. ..... 510/445; 510/446; 510/426; 510/428; 510/492

(58) Field of Search ..... 510/445, 446, 510/424, 426, 428, 492

(56) References Cited

U.S. PATENT DOCUMENTS

| | | | | |
|---|---|---|---|---|
| 1,985,424 | A | | 12/1934 | Piggott |
| 2,016,962 | A | | 10/1935 | Flint et al. |
| 2,703,798 | A | | 3/1955 | Schwartz |
| 3,966,629 | A | | 6/1976 | Dumbrell |
| 4,062,647 | A | | 12/1977 | Storm et al. |
| 4,140,657 | A | * | 2/1979 | Okumura et al. ..... 252/551 |
| 4,534,879 | A | | 8/1985 | Iding et al. |
| 4,737,306 | A | | 4/1988 | Wichelhaus et al. |
| 4,816,553 | A | | 3/1989 | Bauer et al. |
| 4,820,439 | A | | 4/1989 | Rieck |
| 5,189,207 | A | | 2/1993 | Blasey et al. |
| 5,356,607 | A | | 10/1994 | Just |
| 5,516,447 | A | | 5/1996 | Bauer et al. |
| 5,580,941 | A | | 12/1996 | Krause et al. |
| 5,830,956 | A | | 11/1998 | Stockhausen et al. |
| 6,080,711 | A | * | 6/2000 | Brouwer et al. ..... 510/324 |

FOREIGN PATENT DOCUMENTS

| | | |
|---|---|---|
| DE | 23 34 899 | 12/1983 |
| DE | 35 26 405 | 2/1987 |
| DE | 42 03 031 | 8/1993 |
| DE | 42 21 381 | 2/1994 |
| DE | 43 03 176 | 8/1994 |
| DE | 43 03 211 | 8/1994 |
| DE | 43 00 772 | 3/1997 |
| EP | 0 028 432 | 1/1984 |
| EP | 0 164 514 | 6/1989 |
| EP | 0 319 819 | 6/1989 |
| EP | 0 280 223 | 10/1991 |
| EP | 0 026 529 | 8/1992 |
| EP | 0 603 207 | 5/1995 |
| EP | 0 853 117 | 7/1998 |
| GB | 1 400 898 | 7/1975 |
| WO | WO91/08171 | 6/1991 |
| WO | WO95/06106 | 3/1995 |
| WO | WO95/07971 | 3/1995 |

OTHER PUBLICATIONS

Database WPI, week 198633, Derwent Publications Ltd., London, GB; AN 1986–216218 & JP 61148298A, Lion Corp., (Jul. 5, 1986).

Tuvell, et al., "AOS–An Anionic Surfactant System: Its Manufacture, Composition, Properties, and Potential Application," J. Am. Oil Chem. Soc., vol. 55, pp. 70–80, 1978.

* cited by examiner

*Primary Examiner*—Necholus Ogden
(74) *Attorney, Agent, or Firm*—Aaron R. Ettelman; Steven J. Trzaska

(57) ABSTRACT

A surfactant composition containing: (a) from about 75 to 97% by weight of a fatty alcohol sulfate; and (b) from about 3 to 25% by weight of an olefin sulfonate, all weights being based on the total weight of the composition, and wherein the composition is in granular form.

12 Claims, No Drawings

TENSIDE GRANULATES COMPRISING FATTY ALCOHOL SULFATE AND OLEFIN SULFONATES

BACKGROUND OF THE INVENTION

This invention relates to surfactant granules of fatty alcohol sulfates and olefin sulfonates, to a process for their production and to the use of olefin sulfonates for improving the solubility of fatty alcohol sulfate granules in cold water.

Anionic surfactants, more particularly alkyl sulfates or fatty alcohol sulfates, are important constituents of laundry detergents, dishwashing detergents and cleaners. In the process used to produce them, anionic surfactants are obtained in the form of water-containing pastes with water contents of 30 to 75% by weight. In order to obtain solid products, the water-containing pastes are dried, for example in spray-drying towers, or are produced by drying and simultaneous granulation, more particularly in a fluidized bed. It is known, for example from European patent EP 0603207B, that water-containing pastes of alkyl sulfates can be converted into granules of high bulk density by drying and simultaneous granulation in a continuous fluidized bed. It is also possible in this process to incorporate inorganic or organic carrier materials.

$C_{6/18}$ fatty alcohol sulfate granules produced by simultaneous drying and granulation show inadequate solubility and dispersibility at low temperatures. Since the solution to this problem is very important for cold washing processes, the problem addressed by the present invention was to improve the dissolving and dispersing behavior of granular $C_{1/8}$ fatty alcohol sulfates at low temperatures.

DESCRIPTION OF THE INVENTION

The present invention relates to surfactant granules consisting of (a) 75 to 97% by weight, preferably 85 to 95% by weight of fatty alcohol sulfates and (b) 3 to 25% by weight, preferably 5 to 15% by weight of olefin sulfonates, with the proviso that the quantities add up to 100% by weight.

The present invention also relates to a process for the production of surfactant granules in which a water-containing paste of component (a) is simultaneously dried and granulated in the presence of component (b). In another embodiment, the invention relates to the use of olefin sulfonates in quantities of 3 to 25% by weight for improving the solubility of fatty alcohol sulfate granules in cold water.

It has surprisingly been found that, even in small quantities, olefin sulfonates improve the dissolving and dispersing behavior of granular $C_{16/18}$ fatty alcohol sulfates, even at low temperatures. Accordingly, it is of advantage to use olefin sulfonate/fatty alcohol sulfate granules for low-temperature washing processes.

Fatty Alcohol Sulfates

Fatty alcohol sulfates which form component (a) are understood to be alkyl sulfates corresponding to formula (I):

$$R^1O—SO_3X \quad (I)$$

in which $R^1$ is a linear or branched, saturated or unsaturated hydrocarbon radical containing 6 to 18 carbon atoms and X is an alkali metal or alkaline earth metal, ammonium, alkyl ammonium, alkanolammonium or glucammonium. Fatty alcohol sulfates are known anionic surfactants which are preferably obtained by sulfation of native fatty alcohols or synthetic oxoalcohols and subsequent neutralization. Typical examples of fatty alcohol sulfates are the sodium salts of sulfation products of caproic alcohol, caprylic alcohol, 2-ethyl hexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, linolyl alcohol, linolenyl alcohol and elaeostearyl alcohol and the technical mixtures thereof obtained, for example, in the high-pressure hydrogenation of technical methyl esters based on fats and oils or aldehydes from Roelen's oxo synthesis and as monomer fraction in the dimerization of unsaturated fatty alcohols. Fatty alcohols containing 12 to 18 carbon atoms and more particularly 16 to 18 carbon atoms are preferably used. Typical examples are technical fatty alcohol sulfates.

Olefin sulfonates

The granules according to the invention contain as a further constituent (b) olefin sulfonates which are normally obtained by addition of $SO_3$ onto olefins corresponding to formula (II):

$$R^2CH=CH-R^3 \quad (II)$$

in which $R^2$ and $R^3$ independently of one another represent H or alkyl groups containing 1 to 20 carbon atoms, with the proviso that $R^2$ and $R^3$ together contain at least 6 and preferably 10 to 16 carbon atoms, and subsequent hydrolysis and neutralization. Particulars of their production and use can be found in a synoptic article published in J. Am. Oil. Chem. Soc. 55, 70 (1978).

Internal olefin sulfonates may be used although α-olefin sulfonates which are obtained where $R^2$ or $R^3$ is hydrogen are preferably used. Typical examples of the olefin sulfonates used are the sulfonation products obtained by reacting $SO_3$ with 1-, 2-, 3-, 4-octene, 1-, 2-, 3-, 4-, 5-decene, 1-, 2-, 3-, 4-, 5-, 6-dodecene, 1-, 2-, 3-, 4-, 5-, 6-, 7-tetradecene, 1-, 2-, 3-, 4-, 5-, 6-, 7-, 8-hexadecene, 1-, 2-, 3-, 4-, 5-, 6-, 7-, 8, 9-octadecene, 1-, 2-, 3-, 4-, 5, 6-, 7-, 8-, 9-, 10-eicosene and 1-, 2-, 3-,4-, 5-, 6-10- and 11-docosene. The sulfonation is followed by hydrolysis and neutralization, after which the olefin sulfonate is present in the mixture as an alkali metal, alkaline earth metal, ammonium, alkyl ammonium, alkanolammonium or glucammonium salt and preferably as a sodium salt. The hydrolyzed α-olefin sulfonation product, i.e. the α-olefin sulfonates, advantageously consists of ca. 60% by weight of alkane sulfonates and ca. 40% by weight of hydroxyalkane sulfonates, of which 80 to 85% by weight are monosulfonates and 15 to 20% by weight disulfonates.

Both olefin sulfonates in the form of water-containing pastes, for example sodium olefin sulfonate ($C_{14-16}$), Elfan® OS 46 A (Akzo Nobel), and water-free products, for example sodium olefin sulfonate ($C_{14-16}$) Elfan® OS 46 P (Akzo Nobel), may be used.

The present invention also relates to a process for the production of the surfactant granules claimed in claim 1 in which a water-containing paste of component (a) is simultaneously dried and granulated in the presence of component (b).

SKET Granulation

A preferred possibility is to subject the water-containing surfactant paste to so-called SKET granulation. SKET granulation is understood to be a simultaneous granulation and drying process preferably carried out in batches or continuously in a fluidized bed. To this end, a water-containing paste of component (a), for example a 30 to 65% by weight surfactant paste, and component (b) are introduced simultaneously or successively into the fluidized bed through one or more nozzles. If component (b) is present as a solid, it is advisable to introduce it into the fluidized bed through a solids metering unit. Preferred fluidized-bed arrangements have base plates measuring 0.4 to 5 m. The SKET granulation is preferably carried out at fluidizing air flow rates of 1 to 8 m/s. The granules are preferably discharged from the fluidized bed via a sizing stage. Sizing may be carried out, for example, by means of a sieve or by an air stream flowing in countercurrent (sizing air) which is controlled in such a way that only particles beyond a certain size are removed from the fluidized bed while smaller particles are retained in the fluidized bed. The inflowing air is normally made up of the heated or unheated sizing air and the heated bottom air. The temperature of the bottom air is between 80 and 400° C. and preferably between 90 and 350° C. A starting material, preferably SKET granules from an earlier test batch, is advantageously introduced at the beginning of the SKET granulation process. The water from the fatty alcohol sulfate paste evaporates in the fluidized bed, resulting in the formation of partly dried to fully dried nuclei which are coated with further quantities of fatty alcohol surfactants and with olefin sulfonates, granulated and again simultaneously dried. Reference is made in this connection to the Its teaching of German patent applications DE 4303211 A1 and DE 4303176 A1 of which the disclosures are hereby specifically included in the present specification.

Flash Dryer

The simultaneous drying and granulation process may also be carried out in a horizontally arranged thin-layer evaporator with rotating internals of the type marketed, for example, by the VRV company under the name of "Flash Dryer". In simple terms, the flash dryer is a tube which can be heated to different temperatures over several zones. The paste-form starting material, which is introduced by a pump, is projected onto the heated wall by one or more shafts fitted with paddles or plowshares as rotating internals and is dried on the heated wall in a thin layer typically with a thickness of 1 to 10 mm. According to the invention, it has been found to be of advantage to apply a temperature gradient of 170° C. (product entrance) to 20° C. (product exit) to the thin layer evaporator. To this end, the first two zones of the evaporator for example may be heated to 160° C. and the last zone to 20° C. Higher drying temperatures have not been found to be of advantage in view of the thermal lability of the starting materials. The thin-layer evaporator is operated at atmospheric pressure, air being passed through in countercurrent (throughput about 50–150 $m^3/h$). The gas entry temperature is generally in the range from 20 to 30° C. while the exit temperature is in the range from 90 to 110° C.

Besides the drying and granulation of neutralized surfactant pastes, the acidic sulfonation products may also be subjected to spray neutralization as described, for example, in EP 0319819 A1. In this process, the acid and a highly concentrated aqueous sodium hydroxide are separately exposed to a gaseous medium, subsequently combined in stoichiometric quantities, neutralized in a multicomponent nozzle and sprayed into the dryer/granulator under a high propellent gas pressure.

One advantage of the granules is that they are not tacky and have high bulk densities of 300 to 1,200 g/l and preferably 500 to 800 g/l.

Other Methods of Production

Another possible method of producing the surfactant granules according to the invention is to subject the water-containing pastes of components (a) and (b) to vacuum drying. In this process, the water-containing pastes of the surfactants according to the invention, for example a 30 to 65% by weight aqueous paste, are completely concentrated by evaporation and the water-free residue is subsequently ground up into granules.

Commercial Applications

The granules according to the invention consist of components (a) and (b) in the following quantities (based on the solids component):

(a) 75 to 97, preferably 85 to 95% by weight fatty alcohol sulfate and (b) 3 to 25, preferably 5 to 15% by weight olefin sulfonates, with the proviso that the quantities add up to 100% by weight. The quantities shows are based on the active substance content of the components. The granules according to the invention may still contain residual quantities of water, preferably below 5% by weight, based on the granules, after the simultaneous drying and granulation process.

The solubility of the fatty alcohol sulfate granules can be considerably improved by the addition of the olefin sulfonates. Accordingly, the present invention also relates to the use of olefin sulfonates in quantities of 3 to 25% by weight for improving the solubility of fatty alcohol sulfate granules in cold water.

In another embodiment of the present invention, the olefin sulfonate/fatty alcohol sulfate granules are used for the production of laundry detergents, dishwashing detergents and cleaners. They may be present in typical quantities, preferably in the range from 0.1 to 30% by weight, based on the detergent/cleaner.

Besides the granules according to the invention, the laundry detergents, dishwashing detergents and cleaners may contain other typical ingredients such as, for example, anionic surfactants, nonionic surfactants, builders, bleaching agents, bleach activators, detergency boosters, enzymes, enzyme stabilizers, redeposition inhibitors, optical brighteners, soil repellents, foam inhibitors, inorganic salts, dyes and perfumes.

Typical examples of anionic surfactants are soaps, alkyl benzene sulfonates, alkane sulfonates, alkyl ether sulfonates, glycerol ether sulfonates, α-methyl ester sulfonates, sulfo-fatty acids, fatty alcohol ether sulfates, glycerol ether sulfates, fatty acid ether sulfates, hydroxy mixed ether sulfates, monoglyceride (ether) sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, N-acyl amino acids such as, for example, acyl lactylates, acyl tartrates, acyl glutamates and acyl aspartates, alkyl oligoglucoside sulfates, protein fatty acid condensates (more particularly vegetable wheat-based products) and alkyl (ether)phosphates. Where the anionic surfactants contain polyglycol ether chains, they may have a conventional homolog distribution although they preferably have a narrow homolog distribution. Typical examples of nonionic surfactants are fatty alcohol polyglycol ethers, alkyl phenol polyglycol ethers, fatty acid polyglycol esters, fatty acid amide polyglycol ethers, fatty amine polyglycol ethers, alkoxylated triglycerides, mixed ethers and mixed formals, optionally partly oxidized alk(en)yl oligoglycosides and glucuronic acid derivatives, fatty acid-N-alkyl glucamides, protein hydrolyzates (more particularly vegetable wheat-based N products), polyol fatty acid esters, sugar esters, sorbitan esters, polysorbates and amine oxides. Where the nonionic surfactants contain polyglycol ether chains, they may have a conventional homolog distribution although they preferably have a narrow homolog distribution.

A suitable solid builder is, in particular, finely crystalline zeolite containing synthetic and bound water, such as detergent-quality zeolite NaA. However, zeolite NaX and mixtures of NaA and NaX are also suitable. The zeolite may be used in the form of a spray-dried powder or even as an undried stabilized suspension still moist from its production. Where the zeolite is used in the form of a suspension, the suspension may contain small additions of nonionic surfactants as stabilizers, for example 1 to 3% by weight—based on zeolite—of ethoxylated $C_{12-18}$ fatty alcohols containing 2 to 5 ethylene oxide groups or ethoxylated isotridecanols. Suitable zeolites have a mean particle size of less than 10 $\mu$m (volume distribution, as measured by the Coulter Counter Method) and contain preferably 18 to 22% by weight and more preferably 20 to 22% by weight of bound water. Suitable substitutes or partial substitutes for zeolites are crystalline layer-form sodium silicates with the general formula $NaMSi_xO_{2x+1}.yH_2O$, where M is sodium or hydrogen, x is a number of 1.9 to 4 and y is a number of 0 to 20, referred values for x being 2, 3 or 4. Crystalline layer silicates such as these are described, for example, in European patent application EP 0 164 514 A. Preferred crystalline layer silicates are those in which M in the general formula stands for sodium and x assumes the value 2 or 3. Both β- and γ-sodium disilicates $Na_2Si_2O5.yH_2O$ are particularly preferred, γsodium disilicate being obtainable for example by the process described in International patent application WO 91/08171.The powder form detergents according to the invention preferably contain 10 to 60% by weight of zeolite and/or crystalline layer silicates as solid builders, mixtures of zeolite and crystalline layer silicates in any ratio being particularly advantageous. In one particularly preferred embodiment, the detergents contain 20 to 50% by weight of zeolite and/or crystalline layer silicates. Particularly preferred detergents contain up to 40% by weight of zeolite and, more particularly, up to 35% by weight of zeolite, based on water-free active substance. Other suitable ingredients of the detergents are water-soluble amorphous silicates which are preferably used in combination with zeolite and/or crystalline layer silicates. Particularly preferred detergents are those which contain above all sodium silicate with a molar ratio of $Na_2O$ to $SiO_2$ (modulus) of 1:1 to 1:4.5 and preferably 1;2 to 1:3.5. The amorphous sodium silicate content of the detergents is preferably up to 15% by weight and more preferably from 2 to 8% by weight. Phosphates, such as tripolyphosphates, pyrophosphates and orthophosphates, may also be present in the detergents in small quantities. The phosphate content of the detergents is preferably up to 15% by weight and, more particularly, from 0 to 10% by weight. In addition, the detergents may contain layer silicates of natural and synthetic origin. Corresponding layer silicates are known, for example, from patent applications DE 23 34 899 B, EP 0 026 529 A and DE 35 26 405 A. Their suitability for use is not confined to a particular composition or structural formula. However, smectites are preferred, bentonites being particularly preferred. Suitable layer silicates which belong to the group of water-swellable smectites are, for example, those corresponding to the following general formulae:

| | |
|---|---|
| $(OH)_4Si_{8-y}Al_y(Mg_xAl_{4-x})O_{20}$ | montmorillonite |
| $(OH)_4Si_{8-y}Al_y(Mg_{6-z}Li_z)O_{20}$ | hectorite |
| $(OH)_4Si_{8-y}Al_y(Mg_{6-z}Al_z)O_{20}$ | saponite |

where x=0 to 4, y=0 to 2 and z=0 to 6.In addition, small quantities of iron may be incorporated in the crystal lattice of the layer silicates corresponding to the above formulae. By virtue of their ion-exchanging properties, the layer silicates may also contain hydrogen, alkali metal and alkaline earth metal ions, more particularly $Na^+$and $Ca^{2+}$. The quantity of water of hydration is generally in the range from 8 to 20% by weight and is dependent upon the degree of swelling and upon the processing method. Suitable layer silicates are known, for example, from U.S. Pat. No. 3,966,629, U.S. Pat. No. 4,062, 647, EP 0 026 529 A and EP 0 028 432 A. Layer silicates which have been substantially freed from calcium ions and strongly coloring iron ions by an alkali treatment are preferably used. Useful organic builders are, for example, the polycarboxylic acids preferably used in the form of their sodium salts, such as citric acid, adipic acidic acid, succinic acid, glutaric acid, tartaric acid, sugar acids, aminocarboxylic acids, nitrilotriacetic acid (NTA), providing their use is not ecologically unsafe, and mixtures thereof. Preferred salts are the salts of polycarboxylic acids, such as citric acid, adipic acid, succinic acid, glutaric acid, tartaric acid, sugar acids and mixtures thereof. Suitable polymeric polycarboxylates are, for example, the sodium salts of polyacrylic acid or polymethacrylic acid, for example those with a relative molecular weight of 800 to 150,000 (based on acid). Suitable copolymeric polycarboxylates are, in particular, those of acrylic acid with methacrylic acid and acrylic acid or methacrylic acid with maleic acid. Copolymers of acrylic acid with maleic acid which contain 50 to 90% by weight of acrylic acid and 50 to 10% by weight of maleic acid are particularly suitable. Their relative molecular weight, based on free acids, is generally in the range from 5,000 to 200,000, preferably in the range from 10,000 to 120,000 and more preferably in the range from 50,000 to 100,000. It is not absolutely essential to use polymeric polycarboxylates. However, if polymeric polycarboxylates are used, detergents containing biodegradable polymers, for example terpolymers which contain acrylic acid and maleic acid or salts thereof and vinyl alcohol or vinyl alcohol derivatives as monomers or acrylic acid and 2-alkyl allyl sulfonic acid or salts thereof and sugar derivatives as monomers are preferred. The terpolymers obtained in accordance with the teaching of German patent applications DE 42 21 381 A and DE 43 00 772 A are particularly preferred. Other suitable builders are polyacetals which may be obtained by reacting dialdehydes with polyol carboxylic acids containing 5 to 7 carbon atoms and at least 3 hydroxyl groups, for example as described in European patent application EP 0 280 223 A. Preferred polyacetals are obtained from dialdehydes, such as glyoxal, glutaraldehyde, terephthal-aldehyde and mixtures thereof and from polyol carboxylic acids, such as gluconic acid and/or glucoheptonic acid.

Among the compounds yielding hydrogen peroxide in water which are used as bleaching agents, sodium perborate tetrahydrate and sodium perborate monohydrate are particularly important. Other suitable bleaching agents are, for example, peroxycarbonate, citrate perhydrates and salts of peracids, such as perbenzoates, peroxyphthalates or diperoxydodecane-dioic acid. They are normally used in quantities of 8 to 25% by weight. Sodium perborate monohydrate is preferred and is used in quantities of 10 to 20% by weight and preferably in quantities of 10 to 15% by weight. By virtue of its ability to bind free water to form the tetrahydrate, it contributes towards increasing the stability of the detergent.

In order to obtain an improved bleaching effect where washing is carried out at temperatures of 60° C. or lower, bleach activators may be incorporated in the preparations. Examples of bleach activators are N-acyl and O-acyl compounds which form organic peracids with hydrogen peroxide, preferably N,N'-tetraacylated diamines, also carboxylic anhydrides and esters of polyols, such as glucose pentaacetate. The bleach activator content of bleach-containing detergents is in the usual range, i.e. preferably between 1 and 10% by weight and more preferably between 3 and 8% by weight. Particularly preferred bleach activators are N,N,N',N'-tetraacetyl ethylenediamine and 1,5-diacetyl-2,4-dioxohexahydro-1,3,5-triazine.

Suitable enzymes are those from the class of proteases, lipases, amylases, cellulases and mixtures thereof. Enzymes obtained from bacterial strains or fungi, such as *Bacillus subtilis, Bacillus licheniformis* and *Streptomyces griseus*, are particularly suitable. Proteases of the subtilisin type are preferably used, proteases obtained from *Bacillus lentus* being particularly preferred. They may be used in quantities of about 0.2 to about 2% by weight. The enzymes may be adsorbed onto supports and/or embedded in shell-forming materials to protect them against premature decomposition. In addition to the monohydric and polyhydric alcohols and the phosphonates, the detergents may contain other enzyme stabilizers. For example, 0.5 to 1% by weight of sodium formate may be used. It is also possible to use proteases which are stabilized with soluble calcium salts and which have a calcium content of preferably about 1.2% by weight, based on the enzyme. However, it is of particular advantage to use boron compounds, for example boric acid, boron oxide, borax and other alkali metal borates, such as the salts of orthoboric acid ($H_3BO_3$), metaboric acid ($HBO_2$) and pyroboric acid (tetraboric acid $H_2B_4O_7$).

The function of redeposition inhibitors is to keep the soil detached from the fibers suspended in the wash liquor and thus to prevent discoloration. Suitable redeposition inhibitors are water-soluble, generally organic colloids, for example the water-soluble salts of polymeric carboxylic acids, glue, gelatin, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose, methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone are preferably used, for example in quantities of 0.1 to 5% by weight, based on the detergent.

The detergents may contain derivatives of diaminostilbene disulfonic acid or alkali metal salts thereof as optical brighteners. Suitable optical brighteners are, for example, salts of 4,4'-bis-(2-anilino-4-morpholino-1,3,5-triazinyl6-aminoystilbene-2,2'-disulfonic acid or compounds of similar structure which, instead of the morpholino group, contain a diethanolamino group, a methylamino group, an anilino group or a 2-methoxyethylamino group. Brighteners of the substituted diphenyl styryl type, for example alkali metal salts of 4,4'-bis-(2-sulfostyrylydiphenyl, 4,4'-bis-(4-chloro-3-sulfostyryl)-diphenyl or 4-(4-chlorostyryl)4'-(2-sulfostyryl)diphenyl, may also be present. Mixtures of the brighteners mentioned above may also be used. Uniformly white granules are obtained if, in addition to the usual brighteners in the usual quantities, for example between 0.1 and 0.5% by weight and preferably between 0.1 and 0.3% by weight, the detergents also contain small quantifies, for example $10^{-6}$ to $10^{-3}$% by weight and preferably around $10^{-5}$% by weight, of a blue dye. A particularly preferred dye is Tinolux® (a product of Ciba-Geigy).

Suitable soil repellents are substances which preferably contain ethylene terephthalate and/or polyethylene glycol terephthalate groups, the molar ratio of ethylene terephthalate to polyethylene glycol terephthalate being in the range from 50:50 to 90:10.The molecular weight of the linking polyethylene glycol units is more particularly in the range from 750 to 5,000, i.e. the degree of ethoxylation of the polymers containing poly-ethylene glycol groups may be about 15 to 100. The polymers are distinguished by an average molecular weight of about 5,000 to 200,000 and may have a block structure, but preferably have a random structure. Preferred polymers are those with molar ethylene terephthalate: polyethylene glycol terephthalate ratios of about 65:35 to about 90:10 and preferably in the range from about 70:30 to 80:20. Other preferred polymers are those which contain linking polyethylene glycol units with a molecular weight of 750 to 5,000 and preferably in the range from 1,000 to about 3,000 and which have a molecular weight of the polymer of about 10,000 to about 50,000. Examples of commercially available polymers are the products Milease® T (ICI) or Repelotex® SRP 3 (Rhône-Poulenc).

Where the detergents are used in washing machines, it can be of advantage to add conventional foam Inhibitors to them. Suitable foam inhibitors are, for example, soaps of natural or synthetic origin which have a high percentage of $C_{18-24}$ fatty acids. Suitable non-surface-active foam inhibitors are, for example, organopolysiloxanes and mixtures thereof with microfine, optionally silanized silica and paraffins, waxes, microcrystalline waxes and mixtures thereof with silanized silica of bis-stearyl ethylenediamide. Mixtures of various foam inhibitors, for example mixtures of silicones, paraffins or waxes, may also be used with advantage. The foam inhibitors, more particularly silicone- or paraffin-containing foam inhibitors, are preferably fixed to a granular water-soluble or water-dispersible carrier/support. Mixtures of paraffins and bis-stearyl ethylenediamides are particularly preferred.

EXAMPLES

Example 1

Water-containing pastes of $C_{16/18}$ fatty alcohol sulfates and various quantities of α-olefin sulfonate [sodium olefin sulfonate ($C_{14-16}$), Elfan® OS 46, Azko Nobel, 1]$C_{12/14}$ fatty alcohol sulfate sodium salt (C1) and ocenol sulfate sodium salt (C2) were subjected to vacuum drying and then ground into granules. The solubility of these granules was tested in a hand washing test and the residue in % by weight was determined (Table 1). Even when added to the $C_{16/18}$ fatty alcohol sulfate in a quantity of 5%, the α-olefin sulfonate improves its dissolving and dispersing behavior by comparison with C1 and C2.

TABLE 1

Solubility of $C_{16/18}$ fatty alcohol in the hand washing test (% by weight residue)

| Addition (% by wt.) | 1 α-Olefin sulfonate | C1 $C_{12/14}$ Fatty alcohol sulfate sodium salt | C2 Ocenol sulfate sodium salt |
|---|---|---|---|
| 5 | 6.6 | 37.4 | 32.4 |
| 10 | 4.4 | 37.0 | 32.2 |
| 15 | 9.0*) | 36.7 | 28.0 |

*)The results can be falsified by gelation

Example 2

Starting materials (a) $C_{16/18}$ fatty alcohol sulfate Sulfopon® T 55 (51.5% by weight active substance)

(b) α-Olefin sulfonate Elfan® OS 46 (37.0% by weight active substance)

(c) $C_{12/14}$ fatty alcohol sulfate Texapon® LS 35 (35.2% by weight active substance)

(d) Ocenol sulfate sodium salt (59.7% by weight active substance)

TABLE 2

| | Concentrations of the water-containing pastes used (% by weight) | | | | | | | | |
|---|---|---|---|---|---|---|---|---|---|
| Composition | 1 | 2 | 3 | C1 | C2 | C3 | C4 | C5 | C6 |
| (a) + (b) | 93.18<br>6.82 | 86.60<br>13.40 | 80.28<br>19.72 | — | — | — | — | — | — |
| (a) + (c) | — | — | — | 92.85<br>7.15 | 86.02<br>13.98 | 79.48<br>20.52 | — | — | — |
| (a) + (d) | — | — | — | — | — | — | 95.65<br>4.35 | 91.25<br>8.75 | 86.77<br>13.23 |
| Paste concentration | 50.51 | 49.56 | 48.64 | 50.33 | 49.22 | 48.16 | 51.86 | 52.22 | 52.28 |
| Percentage (b) of paste | 5 | 10 | 15 | — | — | — | — | — | — |
| Percentage (c) of paste | — | — | — | 5 | 10 | 15 | — | — | — |
| Percentage (d) of paste | — | — | — | — | — | — | 5 | 10 | 15 |

Production of the Granules in a Fluidized Bed

Water-containing pastes 1 to 3 according to the invention and comparison pastes C1 to C6 were sprayed into the fluidized bed in various test batches.

| Process parameters: | |
|---|---|
| Feed air: | 720 to 750 Nm/h |
| Feed air temperature: | 140 to 150° C. |
| Air exit temperature: | 80 to 85° C. |
| Quantity sprayed: | 21 to 30 kg/h |
| Exhaust air: | 120 to 130 Nm/h |
| Duration of test: | 4 h |
| Quantity of product: | 15 kg |

| | |
|---|---|
| Bulk density: | 500 to 650 g/l |
| Active substance content: | 88 to 97% |
| Residual moisture: | 2.0 to 3.0% |

Solubility test:

The solubility of the granules obtained (1, C1 and C4) was tested in a hand washing test and the residue was determined. Surfactant granules which contain 5% by weight α-olefin sulfonate in addition to 95% by weight $C_{16/18}$ fatty alcohol sulfate (1) show improved solubility (residue: 7.0% by weight) by comparison with granules containing 5% by weight of $C_{12/14}$ fatty alcohol sulfate (C1, residue: 40.0% by weight) or ocenol sulfate sodium salt (C4, residue: 35.0% by weight).

What is claimed is:

1. A surfactant composition comprising:

(a) from about 75 to 97% by weight of a fatty alcohol sulfate; and (b) from about 3 to 25% by weight of an olefin sulfonate, all weights being based on the total weight of the composition, and wherein the composition is in granular form.

2. The composition of claim 1 wherein the fatty alcohol sulfate is present in the composition in an amount of from about 85 to 95% by weight, based on the weight of the composition.

3. The composition of claim 1 wherein the olefin sulfonate is present in the composition in an amount of from about 5 to 15% by weight, based on the weight of the composition.

4. The composition of claim 1 wherein the fatty alcohol sulfate corresponds to formula I:

$$R^1O\text{-}SO_3X \quad (I)$$

wherein $R^1$ is a linear or branched, saturated or unsaturated hydrocarbon radical containing from about 6 to 18 carbon atoms, and is an alkali metal or alkaline earth metal, ammonium, alkyl ammonium, alkenolammonium or glucammonium.

5. The composition of claim 1 wherein the olefin sulfonate is derived by:

(a) addition of $SO_3$ onto an olefin corresponding to formula II:

$$R^2\text{-}CH{=}CH\text{-}R^3 \quad (II)$$

wherein $R^2$ and $R^3$, Independently of one another, represent H or alkyl groups containing from 1 to about 20 carbon atoms, with the proviso that $R^2$ and $R^3$ together contain at least 6 carbon atoms;

(b) hydrolysis; and (c) neutralization.

6. The composition of claim 1 wherein the olefin sulfonate comprises:

(a) ca. 60% by weight of alkane sulfonate; and (b) ca. 40% by weight of hydroxyalkane sulfonate of which 80 to 85% by weight are monosulfonate and 15 to 20% by weight are disulfonate.

7. A process for making surfactant granules comprising:

(a) providing an aqueous paste containing 75 to 97% by weight of a fatty alcohol sulfate;

(b) providing 3 to 25% of an olefin sulfonate; and (c) simultaneously drying and granulating the fatty alcohol sulfate and olefin sulfonate.

8. The process of claim 7 wherein the fatty alcohol sulfate corresponds to formula I:

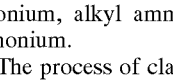

$$R^1O\text{-}SO_3X \quad (I)$$

wherein $R^1$ is a linear or branched, saturated or unsaturated hydrocarbon radical containing from about 6 to 18 carbon atoms, and X is an alkali metal or alkaline earth metal, ammonium, alkyl ammonium, alkanolammonium or glucammonium.

9. The process of claim 7 wherein the olefin sulfonate is derived by:

(a) addition of $SO_3$ onto an olefin corresponding to formula II:

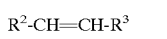

$$R^2\text{-}CH{=}CH\text{-}R^3 \quad (II)$$

wherein $R^2$ and $R^3$, independently of one another, represent H or alkyl groups containing from 1 to about 20 carbon atoms, with the proviso that $R^2$ and $R^3$ together contain at least 6 carbon atoms;

(b) hydrolysis; and (c) neutralization.

10. The process of claim 7 wherein step (c) is performed in a fluidized bed.

11. A cleaning composition containing the surfactant composition of claim 1.

12. The composition of claim 11 wherein the olefin sulfonate is combined with the fatty alcohol sulfate in an amount of from about 3 to 25% by weight, based on the weight of the composition.

* * * * *